US007686961B1

(12) United States Patent
Glynne

(10) Patent No.: US 7,686,961 B1
(45) Date of Patent: Mar. 30, 2010

(54) APPARATUS FOR REMOVING DISSOLVED AND SUSPENDED CONTAMINANTS FROM WASTE WATER

(76) Inventor: Michael J. Glynne, 24 Ryden St., Quincy, MA (US) 02169

( * ) Notice: Subject to any disclaimer, the term of this patent is extended or adjusted under 35 U.S.C. 154(b) by 0 days.

(21) Appl. No.: 11/239,800

(22) Filed: Sep. 30, 2005

Related U.S. Application Data

(60) Provisional application No. 60/670,564, filed on Apr. 12, 2005.

(51) Int. Cl.
*E03F 5/14* (2006.01)

(52) U.S. Cl. ..... 210/693; 210/694; 210/747; 210/804; 210/170.03; 210/265; 210/532.1; 210/538

(58) Field of Classification Search ..... 210/163, 210/164, 170.03, 265, 299, 532.1, 532.2, 210/538, 747, 693, 694, 804; 404/4, 5; 285/201, 285/345; 277/615
See application file for complete search history.

(56) References Cited

U.S. PATENT DOCUMENTS

| | | | | | |
|---|---|---|---|---|---|
| 1,654,247 | A | * | 12/1927 | Egan | 210/164 |
| 1,654,803 | A | * | 1/1928 | Lawrence | 404/4 |
| 2,745,510 | A | * | 5/1956 | Hultgren | 210/532.1 |
| 3,057,408 | A | * | 10/1962 | Griffitts | 277/615 |
| 3,630,370 | A | * | 12/1971 | Quina | 210/538 |
| 3,789,987 | A | * | 2/1974 | Malaspina | 210/533 |
| 4,565,381 | A | * | 1/1986 | Joelson | 285/345 |
| 4,935,132 | A | * | 6/1990 | Schaier | 210/163 |
| 5,096,233 | A | * | 3/1992 | Dlouhy | 285/345 |
| 5,101,849 | A | * | 4/1992 | Richard | 210/532.2 |
| 5,169,161 | A | * | 12/1992 | Jones | 277/615 |
| 6,126,817 | A | * | 10/2000 | Duran et al. | 210/532.1 |
| 6,132,603 | A | * | 10/2000 | Mokrzycki et al. | 210/170.03 |
| 6,217,757 | B1 | * | 4/2001 | Fleischmann | 210/265 |
| 6,270,663 | B1 | | 8/2001 | Happel | 210/163 |
| 6,494,463 | B1 | * | 12/2002 | Rank | 277/615 |
| 6,533,941 | B2 | | 3/2003 | Butler | 210/681 |
| 6,641,720 | B1 | | 11/2003 | Crompton et al. | 210/155 |
| 6,749,746 | B2 | | 6/2004 | Mokrzycki | 210/163 |

FOREIGN PATENT DOCUMENTS

| | | | |
|---|---|---|---|
| GB | 1396888 | * | 6/1975 |
| GB | 2012902 | * | 8/1979 |
| GB | 1567326 | * | 8/1980 |

OTHER PUBLICATIONS

EPA; "Combined Sewer Overflow Technology Fact Sheet Floatables Control"; EPA 832-F99-008 Sep. 1999.

* cited by examiner

*Primary Examiner*—Christopher Upton
(74) *Attorney, Agent, or Firm*—Nields, Lemack & Frame, LLC

(57) ABSTRACT

The present invention provides a method and apparatus for the treatment of waste water, particularly for the treatment and/or reduction of floating pollutants in storm water waste streams. The apparatus of the invention achieves a high containment level of floating pollutants compared to conventional oil/gas traps available for catch basin use. In a preferred embodiment, the device of the invention is a catch basin trap that arrests the flow of pollutants, particularly floating pollutants. The trap is designed and installed in such a manner that a sealed system is created, ensuring that all fluid flow (e.g., storm water discharge) must pass through the trap and cannot bypass the trap due to unreliable trap attachment mechanisms or unsealed joints. Containment of floating pollutants is achieved.

27 Claims, 7 Drawing Sheets

Deep Sump Catch Basin

"The Eliminator"
(Rendered View w/ Cover)

Top View

Enlarged Section 1–1

Enlarged Section 2–2

Enlarged Front View

Front View of Cover w/ Integral Handle

Isometric of Removable Canister

Section 1-1 of Removable Canister

APPARATUS FOR REMOVING DISSOLVED AND SUSPENDED CONTAMINANTS FROM WASTE WATER

This application claims priority of U.S. Provisional Application Ser. No. 60/670,564, filed Apr. 12, 2005, the disclosure of which is incorporated herein by reference.

BACKGROUND OF THE INVENTION

Catch basins are surface-level inlets to sewer systems that serve to allow storm water waste to enter a sewer system. Drainage and storm water is typically collected in catch basins buried in the ground. Water from rain or snow flows into the catch basin, where it is then diverted to a sewer or drainage line.

Grates are usually present at the top surface of the catch basins to help reduce the amount of debris that enters the basin. Filters or traps are often employed to remove various pollutants and solids from the water, such as to minimize or eliminate offensive odors, prevent large solids from entering the catch basin, reduce pollutants, etc. Indeed, governmental regulations often dictate the acceptable levels of various pollutants such as sediment, hydrocarbons and debris. Filters or traps containing activated carbon are commonly used for this purpose. Often the filters are removable, so that they can be replaced once the flow of liquid through the filter becomes impeded due to the accumulation of retentate.

Installation and maintenance of conventional catch basin traps for catch basins is problematic. They must be strategically located to inhibit or prohibit floating pollutants from entering the drainage pipe, yet be easily installed and provide accessibility to the pipe for maintenance and replacement. Most conventional oil/gas traps are made of cast iron, which is very heavy and makes installation extremely difficult. Often drilling into the concrete surrounding the drainage pipe is necessary, which is time-consuming and difficult. Additional installation hardware may be necessary, and installers must often remain in the catch basin (generally an underground confined space that is 4 feet in diameter and seven feet high) for extended lengths of time to install the trap. In addition, conventional gas traps do not maintain an effective seal to prevent floating pollutants from entering the drain pipe.

It therefore would be desirable to provide a gas trap that is lightweight, easy to install, requiring minimal or no installation hardware, and provides a reliable seal once installed.

SUMMARY OF THE INVENTION

The problems of the prior art have been overcome by the present invention, which provides a method and apparatus for the treatment of waste water, particularly for the treatment and/or reduction of floating pollutants in storm water waste streams. The apparatus of the invention achieves a high containment level of floating pollutants compared to conventional oil/gas traps available for catch basin use.

In a preferred embodiment, the device of the invention is a catch basin trap that arrests the flow of pollutants, particularly floating pollutants. The trap is designed and installed in such a manner that a sealed system is created, ensuring that all fluid flow (e.g., storm water discharge) must pass through the trap and cannot bypass the trap due to unreliable trap attachment mechanisms or unsealed joints. Containment of floating pollutants is achieved.

In a second embodiment, the device of the invention also arrests the flow of oil and oil based products, most specifically in the event of a spill. Oil absorbing particulate in the trap expands, thereby blocking the passage of all waste water through the trap.

DETAILED DESCRIPTION OF THE INVENTION

Figure 1:
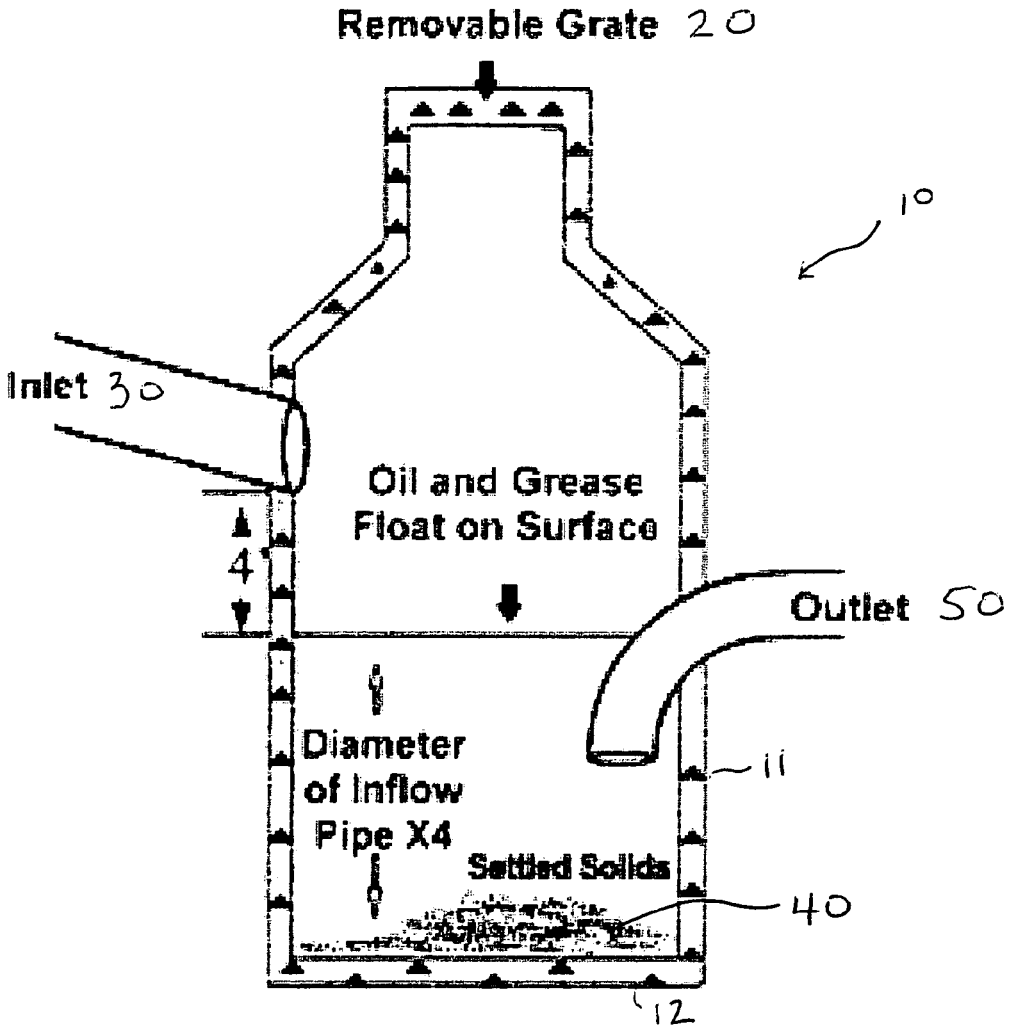
FIG. 1 illustrates a catch basin.

Catch basin traps are well known in the industry, and used in most catch basins to arrest the flow of pollutants into drainpipes and sewer lines. FIG. 1 illustrates a typical catch basin 10. The basin 10 is typically constructed with concrete walls 11 and a concrete base 12. At the top, typically a grate 20 or other entry means is located. Wastewater, as well as litter, oil, dirt and other pollutants, pass through the grate 20 and into the catch basin 10. Optionally, additional entry means 30 are also located within the catch basin. Solid wastes 40 that are heavier than water settle at the bottom of the catch basin 10. However, oil and other low density pollutants float on the top of the wastewater within the catch basin. To prevent these pollutants from entering outlet 50, various techniques are used. As shown in FIG. 1, a pipe having a bend so as to have its opening below the surface of the wastewater can be used to prevent the floating pollutants from entering outlet 50.

Figure 2:
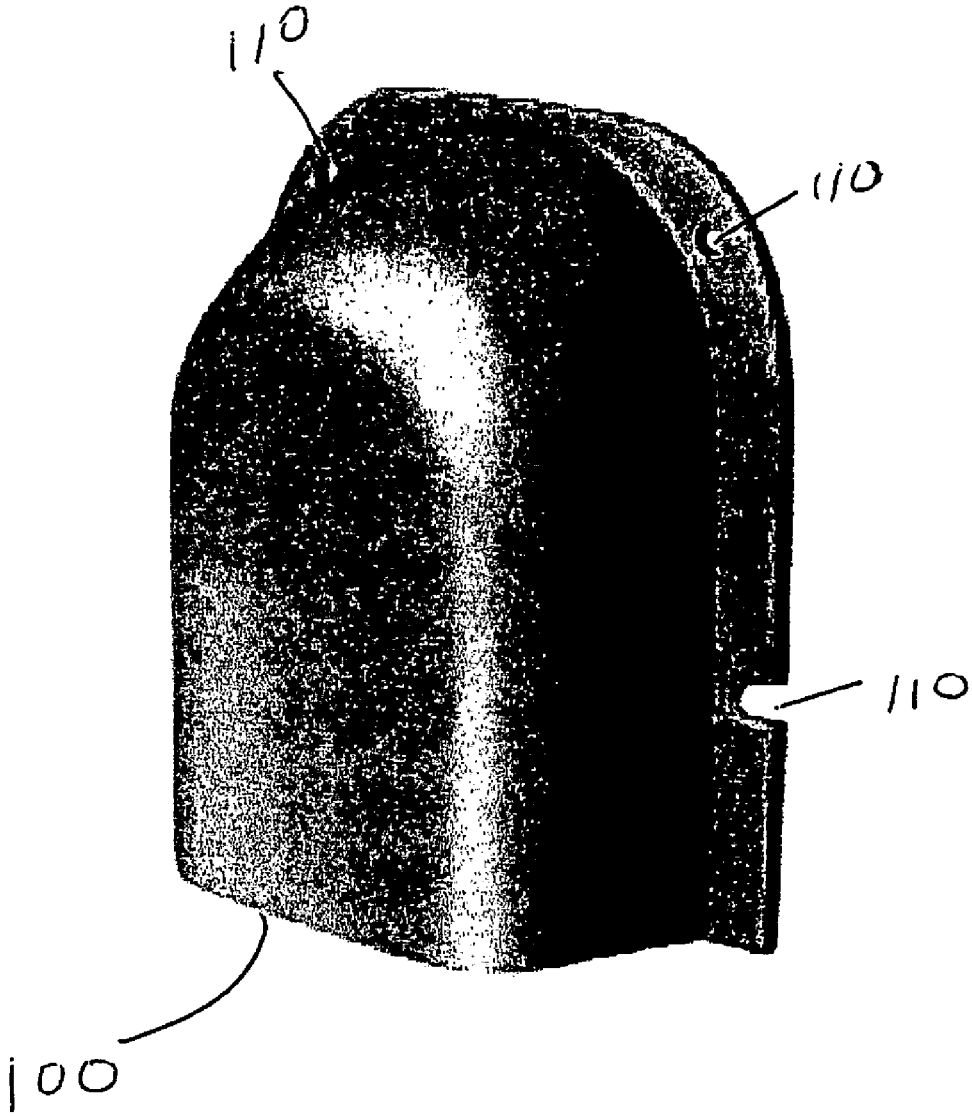
FIG. 2 is a perspective view of a catch basin trap of the prior art.

Alternatively, as shown in FIG. 2, a catch basin trap 100 (or hood) may be employed. The trap 100 is typically constructed from cast iron and is mounted to the concrete wall 11 of the basin 10 such that it covers the outlet 50. Typically, the trap is held in position through the use of anchor screws. In the embodiment shown in FIG. 2, the trap 100 has four mounting locations 110, through which anchor screws are inserted and then secured to the concrete wall 11.

The installation of the prior art trap shown in FIG. 2 is a long and tedious process, requiring the installer to remain in the catch basin for several hours while drilling holes into which the anchor screws will be mounted. Furthermore, since the trap is mounted to a curved concrete wall and held in position at only four locations, the trap 100 does not form a watertight seal with the concrete wall 11. This allows some amount of pollutant to pass between the trap and wall and thereafter enter the drain outlet 50, thereby defeating the purpose of the trap.

Figure 3A:
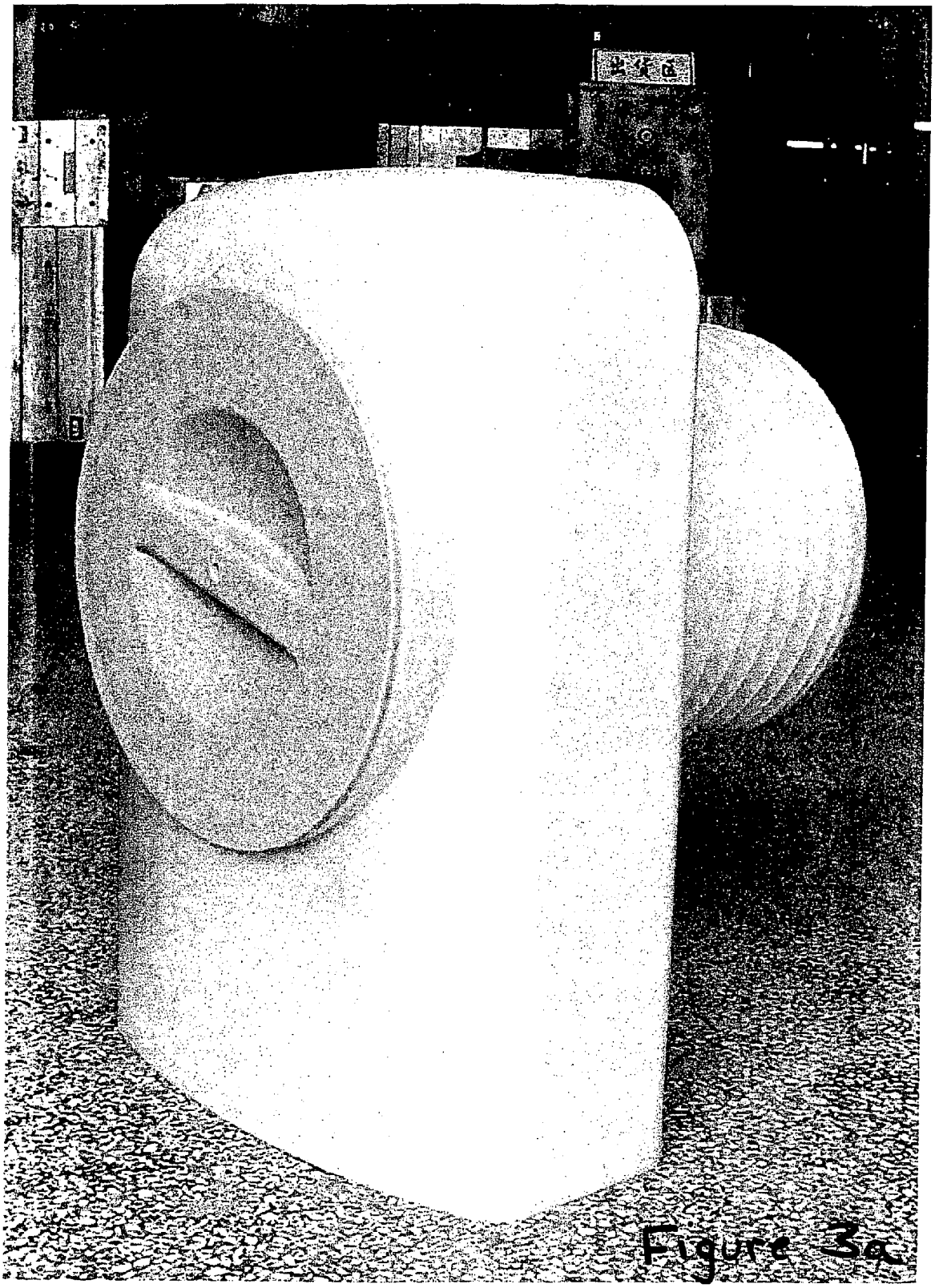
FIG. 3*a* is a first perspective view of the catch basin trap of the present invention.
Figure 3B:
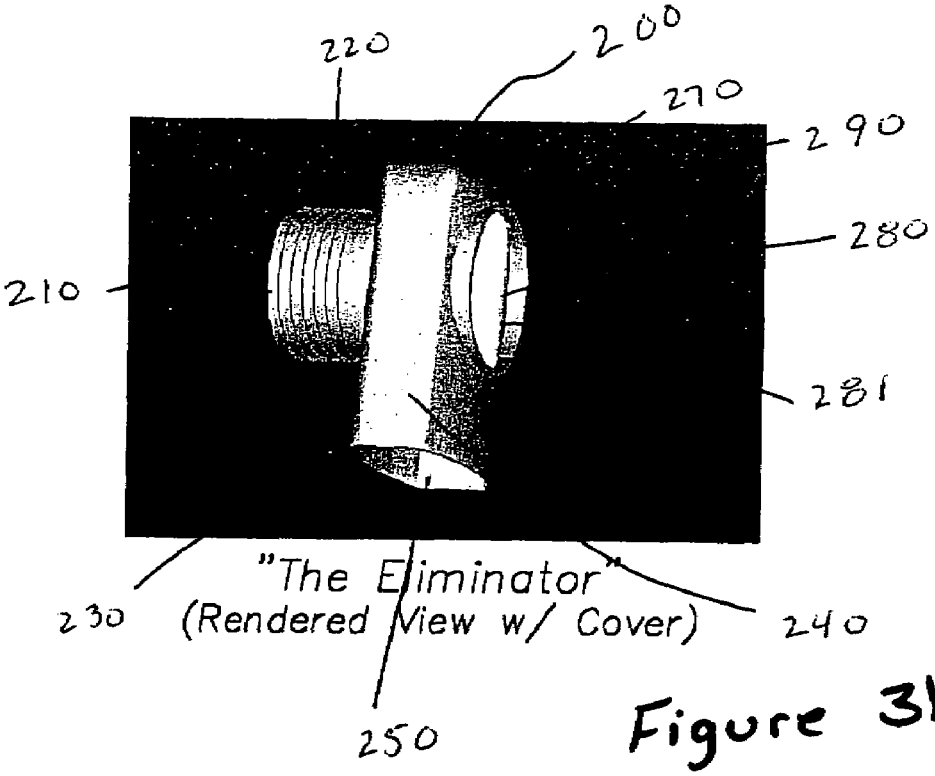
FIG. 3*b* is a second perspective view of the catch basin trap of the present invention.
Figure 4:
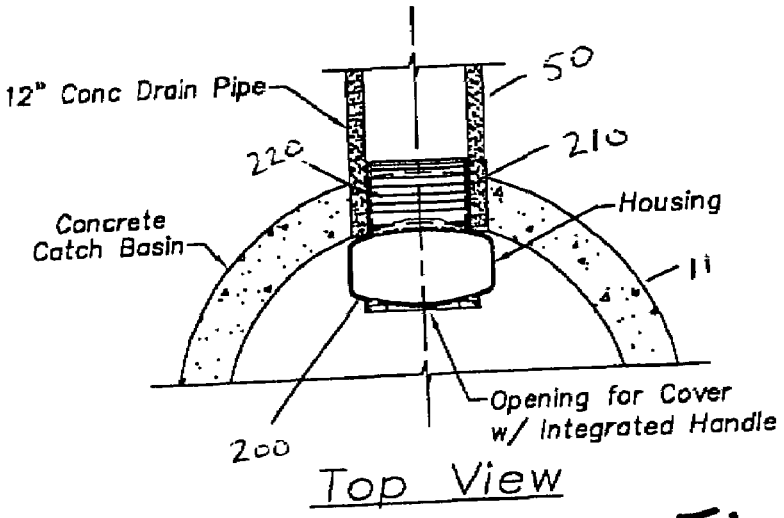
FIG. 4 is a top view of the catch basin trap as used in a catch basin.
Figure 5:
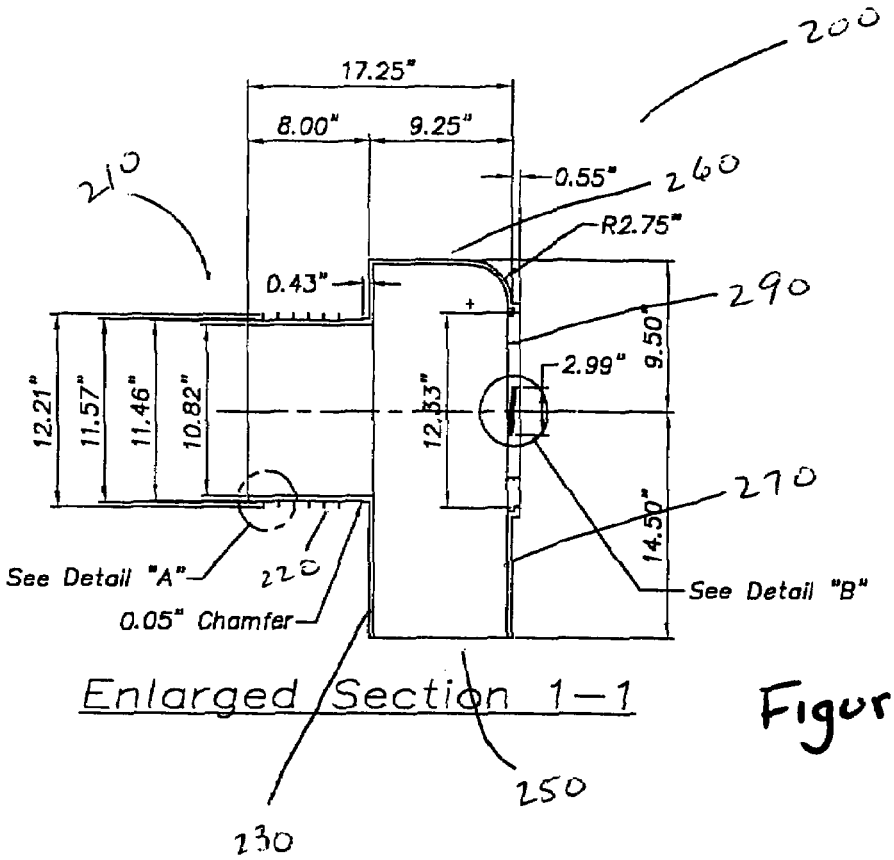
FIG. 5 is a side view of the catch basin trap of the present invention.
Figure 6:
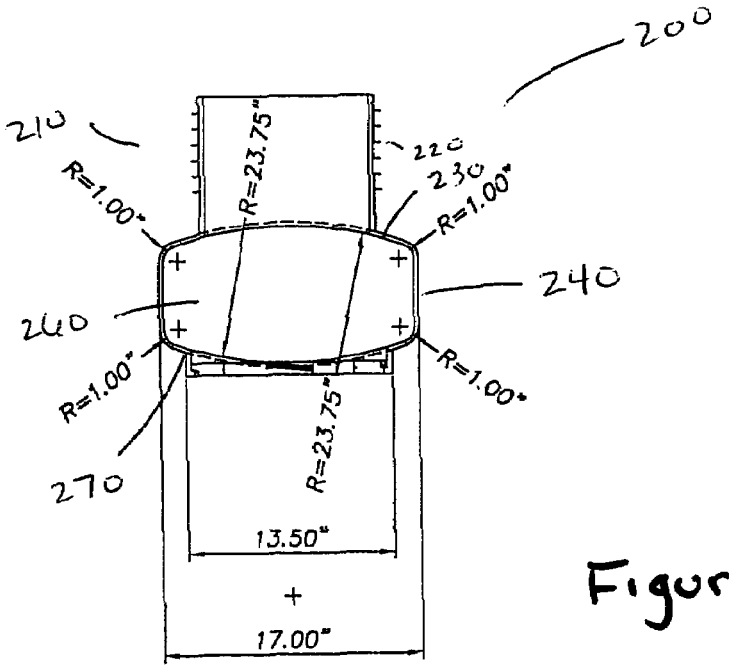
FIG. 6 is a top view of the catch basin trap of the present invention.
Figure 7:
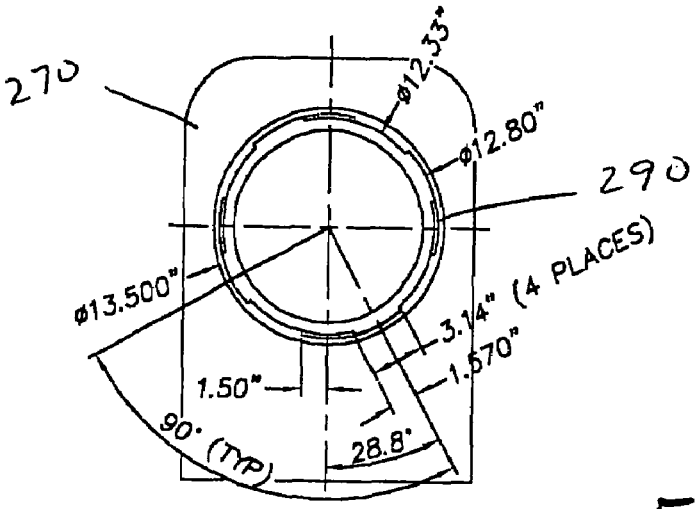
FIG. 7 is a front view of the catch basin trap of the present invention.

The device of the present invention overcomes these problems by providing a trap that is affixed to the catch basin with a water and oil tight seal, thereby preventing the flow of pollutants past the trap. FIGS. 3*a* and 3*b* illustrate perspective views of the present invention. FIGS. 4 through 7 illustrate the various views of the trap of the present invention. Unlike conventional traps, which are secured to the concrete wall of the catch basin, the present invention is inserted directly into the drain outlet. This allows the trap to be installed in less than 5 minutes. The trap 200 of the present invention is preferably constructed from high density polyethylene (HDPE) so as to be both durable and lightweight. The trap 210 has a longitudinal cylinder 210, which is suitably sized and shaped to be effectively inserted into a standard drain outlet 50. In the preferred embodiment, the longitudinal cylinder 210 has a length of approximately eight inches and a constant diameter along its length, although other lengths are possible and within the scope of the invention. Since most drain outlet pipes have a standard inner diameter of 12 inches, the outer diameter of the longitudinal cylinder must be smaller than this. In the preferred embodiment, the outer diameter of the longitudinal cylinder is between 11.25 and 11.75 inches.

Along the outer diameter of the longitudinal cylinder 210 are a series of preferably equally spaced ridges, or fins 220. Each of these fins 220 preferably has a height of between roughly 0.25 and 0.50 inches and a thickness of roughly 0.5 mm. Thus, with the added height of the fin, the outer diameter of the cylinder as measured around the fin will exceed the inner diameter of the drain outlet. This combination of height and thickness also allows the fin to be pliable enough to bend to conform to the inner diameter of the drain outlet 50. However, the fins are strong enough to provide a water tight and oil tight seal between the trap 200 and the inner diameter of the drain outlet 50. The fins also serve to retain the trap in place in the drain outlet. While these dimensions are preferable, other combinations of thickness and height are also possible and within the scope of the invention. For example, the fins may also be tapered such that they are thicker at the base near the longitudinal cylinder and thinner at the far end. These fins are preferably molded into the longitudinal cylinder.

In the preferred embodiment, a plurality of fins 220, most preferably between 4 and 6, is provided along the length of the longitudinal cylinder. A high number of fins increases the force required to extract the trap from the drain outlet, and improves the quality of the seal between the trap and the drain outlet. In the preferred embodiment, the fins are integral with the cylinder and therefore constructed from high density polyethylene. The materials of construction of the drain outlet can influence the extent to which the trap can be extracted. It is desirable that the force necessary to extract the trap be as high as possible, so as to reduce or eliminate trap failure and sealing issues. For example, reinforced concrete pipes have a relatively high coefficient of friction compared to HDPE pipes, so the force required to extract the trap from a reinforced concrete drain outlet is higher than that of an HDPE drain outlet. Accordingly, at least one additional fin may be desirable or necessary where the trap is to be installed in an HDPE drain pipe or the like in order to ensure a proper seal and retention of the trap therein.

The fins are spaced apart from one another so as not to touch even when inserted into the drain outlet. In the preferred embodiment, this spacing is approximately one inch, although other spacings are possible and within the scope of the invention. In the preferred embodiment, the longitudinal cylinder has a wall thickness of roughly 0.25 to 0.50 inches, most preferably 0.375 inches.

In an alternate embodiment, the longitudinal cylinder has one or more sealing means, such as gaskets or O-rings along its outer circumference. These sealing device create a water tight and oil tight seal between the longitudinal cylinder and the drain outlet.

The trap also comprises a rear wall 230, perpendicular to the longitudinal cylinder 210, to which the cylinder is affixed or integral. The rear wall 230 is preferably constructed from the same material as the longitudinal cylinder. Since the rear wall is in close proximity to the concrete wall of the catch basin when installed, it is preferably arcuate in shape. This arc should correspond to that of the concrete wall of the catch basin, and in the preferred embodiment, the radius of the arc is roughly 23.75 inches. The rear wall 230 is preferably 17 inches wide and 24 inches long. To insure that floating pollutants to do enter the drain outlet, the rear wall extends below the lower edge of the longitudinal cylinder 210, preferably at least 8 inches below the lower edge of the cylinder. The rear wall 230 also extends above the upper edge of the longitudinal cylinder 210, preferably at least 2 inches.

On either edge of the rear wall 230 are two side walls 240 which extend the entire length of the rear wall. These side walls extend perpendicularly from the rear wall. The lengthwise dimension of the rear wall and the side walls defines the area into which wastewater can flow as it enters the drain outlet. In the preferred embodiment, the wastewater enters the trap through an opening 250 that is roughly 17 inches long and 9 inches wide, and is preferably arranged so that the flow of water from the opening to the drain outlet makes a 90° turn.

In certain embodiments, the trap also may include a top wall 260, which can extend from the upper edge of the rear wall and attaches to the upper edges of the side walls 240. The top wall is intended to prevent wastewater from entering the drain outlet from above, thereby forcing all wastewater to enter the drain outlet through the previously described submerged opening 250.

Figure 8:
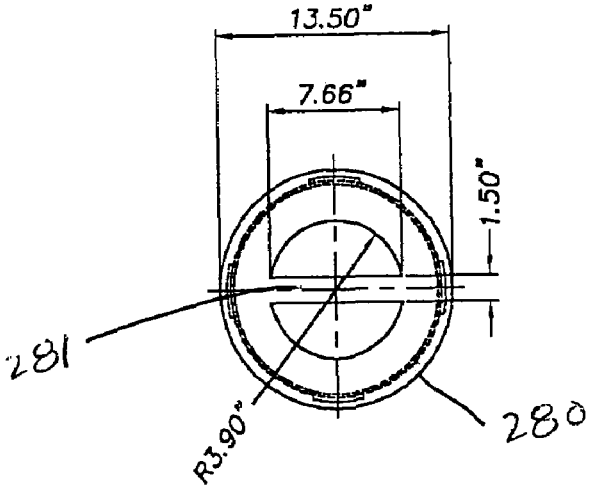
FIG. 8 is a front view of the removable cover of the present invention.

The trap may also have a front wall 270 that is preferably arcuate, similar to the rear wall. The front wall attaches to the top wall 260 and the two side walls 240, leaving only an opening 250 at the bottom of the trap. The front wall 270 may include a removable cover 280. The removable cover allows the operator or repairman to access the drain outlet directly. The removable cover 280 is preferably threaded, as is the front opening 290 into which the cover can be attached. To insure the water tightness of the connection, the cover 280 or front opening 290 may have a seal or other gasket. To ease in removal and reinsertion, the removable cover 280 preferably has a handle 281, which can be molded into the plastic, as shown in FIG. 8, or affixed externally. The removable cover 280 preferably has a radius at least as large as that of the longitudinal cylinder and also has its center aligned with that of the longitudinal cylinder.

Figure 9:
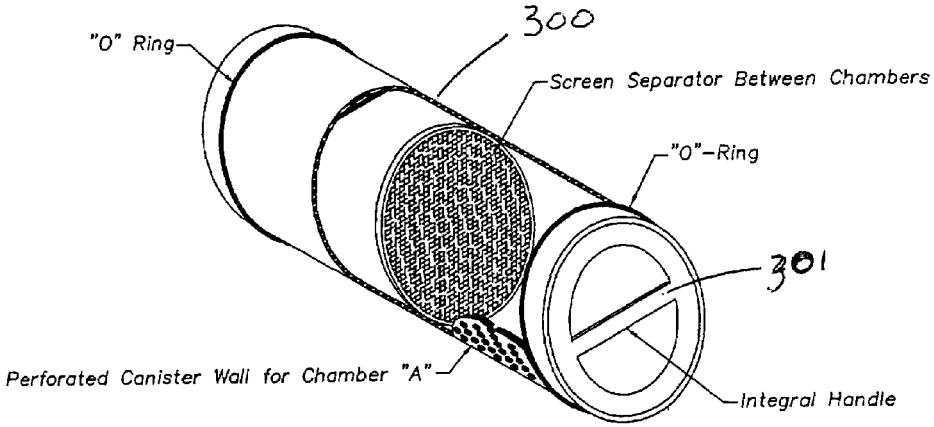
FIG. 9 is a perspective view of the removable canister of the present invention.

In an alternative embodiment, the front opening 290 is used to insert a treatment canister 300, as illustrated in FIG. 9. The canister is adapted to enter the longitudinal cylinder by way of the front opening. As is the case with the removable cover 280, the treatment canister has a handle 301, which can be molded into the plastic or affixed externally. The treatment canister 300 can vary in length and in the preferred embodiment is dimensioned so as to extend past the distal end of the longitudinal cylinder. To insure a water tight and oil tight seal between the outer diameter of the treatment canister and the inner diameter of the longitudinal cylinder, sealing means, including but not limited to fins, gaskets, and O-rings, may be employed.

The treatment canister 300 is perforated at the end nearest the handle so as to allow the entry of wastewater into the canister. These region of the perforations can vary in length. A smaller region insures that the wastewater passes through the largest amount of treatment chemicals; while a larger region allows a greater rate of flow. The dimension of the perforated region is based on the implementation and the various criteria involved.

Within the canister are activated carbon pellets. These carbon pellets are well known in the art and have a long history of reliable use for the removal of hydrocarbons from the wastewater. In one embodiment, the entire volume of the treatment canister is filled with activated carbon pellets.

Figure 10:
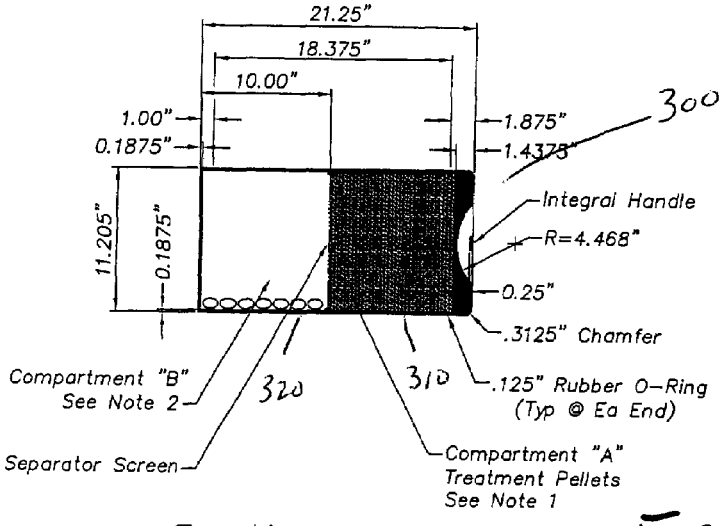
FIG. 10 is a side view of the removable canister of the present invention.

In a second embodiment, the treatment canister 300 is divided into several separate compartments. One compartment 310, preferably the one closest to the handle 301, contains activated carbon pellets for the removal of hydrocarbons as described above. A second compartment 320, as shown in FIG. 10, contains oil absorbing polymer pellets. These pellets rapidly expand as they absorb oil. Thus, in the event of an oil spill or similar accident, the polymer pellets absorb the oil as it passes through the second compartment. As the pellets absorb oil, they expand, thereby restricting the flow of wastewater through the canister. A sufficient amount of oil will cause the pellets to absorb to the point where they completely restrict the flow of wastewater through the canister. This then allows cleaning crews to respond and clean up the contaminants. Once the spill is contained and cleaned, the crew would then replace the treatment canister, thereby restoring the normal operation of the trap. In this way, wetlands and other drainage areas are not polluted by oil passing through the drain outlet before the spill is contained.

The compartments described above are preferably separated by a screen that is constructed of metal or plastic, such as HDPE. The above description details the use of one or two compartments; where the first is adapted to remove hydrocarbons and the second is adapted to remove and block the passage of oil. However, the invention is not limited to this embodiment. For example, additional or substitute compartments can be employed which remove specific contaminants from the wastewater.

What is claimed:

1. A self-retaining trap adapted to be mounted in a drain pipe of an attached catch basin, for minimizing the flow of pollutants floating on the surface of wastewater within said catch basin into said drain pipe, said drain pipe having an internal diameter, said trap comprising:

a longitudinal cylindrical member adapted to be sealingly inserted into said drain pipe in said catch basin; said longitudinal cylindrical member having an external diameter smaller than said internal diameter of said drain pipe and having at least one integral sealing fin extending beyond said external diameter for sealingly engaging said drain pipe, creating a watertight seal and retaining said trap in said drain pipe; and an opening positioned in said trap such that when said trap is mounted in said drain pipe, said opening is submerged below said surface of said wastewater for providing fluid communication from said catch basin to said drain pipe through said longitudinal member, said cylindrical member being connected to an arcuate rear wall of said trap, said rear wall having an arc approximately corresponding to that of a wall of said catch basin and being located proximate said wall of said catch basin.

2. The trap of claim 1, wherein said trap comprises high density polyethylene.

3. The trap of claim 1, further comprising a front wall located opposite said longitudinal cylindrical member, wherein said front wall comprises a second opening, wherein the center of said second opening is aligned with the center of center longitudinal cylindrical member.

4. The trap of claim 3, further comprising a circular cover adapted to be inserted into said second opening.

5. The trap of claim 4, wherein said cover comprising a handle.

6. The trap of claim 3, further comprising a canister, adapted to be inserted through said second opening and to be positioned within said longitudinal cylindrical member.

7. The trap of claim 6, wherein said canister comprises activated carbon pellets.

8. The trap of claim 6, wherein said canister comprises oil absorbing polymer pellets.

9. The trap of claim 6, wherein said canister comprises a plurality of compartments.

10. The trap of claim 1, wherein said longitudinal member comprises a plurality of spaced fins.

11. The trap of claim 10, wherein said plurality of integral sealing fins are equally spaced.

12. The trap of claim 10, wherein said plurality of integral sealing fins are configured such that adjacent fins never overlap.

13. The trap of claim 12, wherein the distance between adjacent fins is greater that the height of each of said fins.

14. A method of minimizing the flow of pollutants floating on the surface of wastewater within a catch basin into a drain pipe, said drain pipe having an internal diameter, said method comprising:

Providing a catch basin with an attached drain pipe; and

Providing a trap comprising a longitudinal cylindrical member adapted to be sealingly inserted into said drain pipe in said catch basin, said longitudinal cylindrical member having an external diameter smaller than said internal diameter of said drain pipe and having at least one integral sealing fin extending beyond said external diameter for sealingly engaging said drain pipe and creating a watertight seal, and wherein said integral sealing fin is configured to retain said trap in said drain pipe, said trap further comprising an opening submerged below said surface of said wastewater for providing fluid communication from said catch basin to said drain outlet through said longitudinal member , said cylindrical member being connected to an arcuate rear wall of said trap, said rear wall having an arc approximately corresponding to that of a wall of said catch basin and being located proximate said wall of said catch basin; and Inserting said trap into said drain pipe, thereby causing said at least one integral sealing fin to sealingly engage said drain pipe.

15. The method of claim 14, wherein said trap further comprises a front wall located opposite said longitudinal cylindrical member, wherein said front wall comprises a second opening, wherein the center of said second opening is aligned with the center of center longitudinal cylindrical member, said method further comprising inserting a canister into said second opening of said trap.

16. The method of claim 15 wherein said canister comprises activated carbon pellets.

17. The method of claim 15 wherein said canister comprises oil absorbing polymer pellets.

18. The method of claim 14, wherein said trap further comprises a plurality of equally spaced integral sealing fins extending beyond said external diameter.

19. The method of claim 14, wherein said trap comprises a plurality of integral sealing fins configured such that adjacent fins never overlap.

20. The method of claim 19, wherein the distance between adjacent fins is greater that the height of each of said fins.

21. A combination comprising:

A catch basin having an attached drain pipe, and

A self-retaining trap comprising a longitudinal cylindrical member sealingly inserted into said drain pipe in said catch basin, said longitudinal cylindrical member having an external diameter smaller than said internal diameter of said drain pipe and having at least one integral sealing fin extending beyond said external diameter for sealingly engaging said drain pipe, creating a watertight seal and retaining said trap in said drain pipe, said trap further comprising an opening submerged below said surface of said wastewater for providing fluid communication from said catch basin to said drain outlet through said longitudinal member, said cylindrical member being connected to an arcuate rear wall of said trap, said rear wall having an arc approximately corresponding to that of a wall of said catch basin and being located proximate said wall of said catch basin.

22. The combination of claim 21, wherein said longitudinal member comprises a plurality of spaced fins.

23. The combination of claim 22, wherein said plurality of integral sealing fins are equally spaced.

24. The combination of claim 22, wherein said plurality of integral sealing fins are configured such that adjacent fins never overlap.

25. The combination of claim 24, wherein the distance between adjacent fins is greater that the height of each of said fins.

26. The combination of claim 21, wherein said trap further comprises a front wall located opposite said longitudinal cylindrical member, wherein said front wall comprises a second opening, wherein the center of said second opening is aligned with the center of center longitudinal cylindrical member and said trap further comprising a canister, adapted to be inserted through said second opening and to be positioned within said longitudinal cylindrical member.

27. The combination of claim 26, wherein said canister comprises activated carbon pellets.

* * * * *